United States Patent [19]

Yoshida et al.

[11] Patent Number: 4,505,788

[45] Date of Patent: Mar. 19, 1985

[54] PRODUCTION OF P-AMINOBENZOYLGLUTAMIC ACID BY ELECTROCHEMICAL REDUCTION

[75] Inventors: Kokichi Yoshida; Takao Niinobe, both of Hikari; Takashi Baba, Kumage, all of Japan

[73] Assignee: Takeda Chemical Industries, Ltd., Osaka, Japan

[21] Appl. No.: 615,527

[22] Filed: May 31, 1984

[30] Foreign Application Priority Data

May 31, 1983 [JP] Japan ..... 58-97377

[51] Int. Cl.[3] ..... C25B 3/00

[52] U.S. Cl. ..... 204/74

[58] Field of Search ..... 204/74, 72, 59 R

[56] References Cited

U.S. PATENT DOCUMENTS 3,475,299 10/1969 Slager ..... 204/74

OTHER PUBLICATIONS

J.A.C.S. 79, 4391–4394, (1957).

Journal of Applied Electrochemistry 5, 125–128, (1975).

*Primary Examiner*—John F. Niebling

*Attorney, Agent, or Firm*—Wenderoth, Lind & Ponack

[57] ABSTRACT

Disclosed is a method of producing p-aminobenzoylglutamic acid which comprises electrochemically reducing p-nitrobenzoylglutamic acid and/or p-hydroxyaminobenzoylglutamic acid using a cathode of a palladium metal or palladium alloy in an aqueous solution at a pH value of 3 or less.

The method produces the objective p-amino compound in good yields and in high current efficiencies, and is advantageous for an industrial method.

6 Claims, No Drawings

PRODUCTION OF P-AMINOBENZOYLGLUTAMIC ACID BY ELECTROCHEMICAL REDUCTION

This invention relates to a method of producing p-aminobenzoylglutamic acid by electrochemical reduction.

p-Aminobenzoylglutamic acid is a useful compound which has been used as a synthetic intermediate for the production of medicines such as folic acid, and has been commonly produced by reducing p-nitrobenzoylglutamic acid. For this purpose, chemical reduction (Specification of U.S. Pat. No. 2,537,366, for instance) and catalytic hydrogenation (Journal of American Chemical Society 79, pp. 4391–4394, 1947, for instance) have been proposed, but to the best of our knowledge, there has not been a single known process for electrochemical reduction of p-nitrobenzoylglutamic acid to the corresponding p-amino compound.

There are many reports on the electrochemical reductions of aromatic nitro compounds, but the products formed invariably include not only the corresonding amino compound but also the hydroxyamino compound and rearrangement products. In order to increase a yield of the amino compound, it is generally necessary to run the electrolysis under severe conditions, e.g. at an elevated temperature or with use of an electrode having a high hydrogen overvoltage. However, such conditions rather tend to cause decomposition of the compounds or induce side reactions and thereby detract from the yield of the desired amino compound and the current efficiency.

The present inventors studied electrochemical reduction of p-nitrobenzoylglutamic acid and completed industrially advantageous methods of producing p-aminobenzoylglutamic acid. The inventors found that in electrochemical reduction of p-nitrobenzoylglutamic acid the desired amino product was obtainable by using a palladium metal as a cathode in high yields and high current efficiencies. We also found that a palladium cathode was particularly effective in the conversion step of p-hydroxyaminobenzoylglutamic acid, which was produced as an intermediate in electrochemical reduction of p-nitrobenzoylglutamic acid, into its amino compound. There was further found that at the catholyte pH value of 5 or more undesired reaction occured toward the end of reduction and solubility of the amino compound was minimum at pH 3 and, therefore, the reduction proceeded in an aqueous solution of less than pH 3 effectively and smoothly. The present invention have been accomplished based on these findings.

Thus, this invention relates to a method of producing p-aminobenzoylglutamic acid which comprises electrochemically reducing p-nitrobenzoylglutamic acid and/or p-hydroxyaminobenzoylglutamic acid using a cathode of a palladium metal or palladium alloy in an aqueous solution at a pH value of 3 or less. The cathode in this invention may be made of a palladium metal or an alloy of palladium. For practical purposes and from economic points of view, a palladium metal may be thinly coated on a cathode in the form of palladium metal or thinly deposited on a cathode substrate in the form of palladium black. The base electrode substrate for application of palladium may, for example, be nickel, silver, carbon, titanium or tantalum metal, and further may be titanium or tantalum metal coated with a noble metal such as rhodium or platinum. The palladium alloy may, for example, be a nickel-palladium or titanium-palladium alloy. As to the palladium content of the alloy, from industrial points of view it is 2 to 20 weight percent in the case of nickel-palladium alloy and 0.05 to 0.5 weight percent in the case of titanium-palladium alloy.

Among the cathode usable in this invention, those particularly preferred are palladium black-deposited cathode such as palladium black-deposited platinum-coated titanium plates. The deposition of palladium black on the cathode can be executed by adding a palladium salt such as palladium chloride to an acidic catholyte containing hydrochloric acid, followed by passing a current of 0.05 to 0.2 A/dm$^2$ through the cell.

As an anode, a plate of acid-resistant metal such as platinum plate, platinum-coated titanium plate and tantalum, can be employed.

The electrochemical reduction according to this invention is conducted in an electrolytic cell which is divided into cathode and anode compartments by a diaphragm. The diaphragm is preferably a cation exchange membrane [e.g. C.M.V®, manufactured by Asahi Glass Co., Ltd.; Nafion® manufactured by E. I. du Pont].

As the catholyte and anolyte, aqueous hydrochloric acid or aqueous sulfuric acid can be used. To control pH of electrolyte an inorganic acid such as hydrochloric acid and sulfuric acid can be used. To the catholyte, highly dissociable salts such as sodium chloride, ammonium chloride, sodium sulfate, ammonium sulfate, etc. may be added as cosolvent supporting electrolytes, if necessary.

The electrochemical reduction is preferably carried out in the stage of an aqueous solution of the starting material, but may be carried out in the stage of a suspension. p-Nitrobenzoylglutamic acid can be subjected to the reduction maintaining a concentration of about 0.5 to 5 wt. % and p-hydroxylaminobenzoylglutamic acid can be subjected to the reduction maintaining a concentration of about 0.5 to 20 wt. %. The starting material p-hydroxyaminobenzoylglutamic acid can be easily obtained by electrochemical reduction of p-nitrobenzoylglutamic acid using a conventional electrode such as titanium, nickel, copper and silver metal. The cathode of the present invention is also usable. A current density employed for the electrolysis is 5 to 20 A/dm$^2$, preferably 8 to 15 A/dm$^2$. The electrolyte is maintained an acidic media, preferably at a pH region of 3 to 7. The reaction can be carried out at a temperature from 0° to 30° C. The reaction mixture, thus obtained, containing p-hydroxyaminobenzoylglutamic acid is usable as a starting material of the present invention. This reaction mixture to be used may contain unreacted p-nitro compound.

The electrochemical reduction in the present invention is carried out by controlling and maintaining a catholyte at a pH of 3 or less, preferably 0.1 to 2. The reduction temperature is between 10 and 70° C., preferably between 30 and 50° C. The current density employed is dependent on the concentration of a starting material in the catholyte, normally in a region of 3 to 10 A/dm$^2$, preferably in a region of 5 to 7 A/dm$^2$ in the case of p-nitrobenzoylglutamic acid material, and in a region of 5 to 15 A/dm$^2$, preferably in a region of 8 to 12 A/dm$^2$ in the case of p-hydroxyaminobenzoylglutamic acid material. As the reduction proceeds, the current to be passed through may be gradually lowered as is done in a conventional manner.

To separate p-aminobenzoylglutamic acid from the solution electrolyzed, such procedures as concentration and pH adjustment with an alkali can be employed.

The electrochemical reduction according to this invention can be conducted in an electrolytic cell of various types commonly used for electrochemical reactions such as tank types, filter press types and plate-and-frame types. Particularly, the filter press type or the plate-and-frame type cell can be employed advantageously from the industrial point of view. In these cells, both electrolytes are generally circulated via their respective intertanks by the circulating pumps. The flow rate of catholyte should be set at 5 cm/sec at least in order to avoid the lowering of the current efficiency.

According to the present invention, the yield of the objective amino compound is high and the current efficiency is also high. Therefore, this invention is a very useful as a commercial process. Particularly, when p-hydroxyaminobenzoylglutamic acid is used as a starting material of the present method, there are technical advantages of enabling the reduction to proceed at a high content solution of the starting material and of being saved from the consumption of palladium cathode. When the objective compound of this invention is used as a starting compound for the production of folic acid, the electrochemical reaction mixture can be usable as it is.

This invention will be described more specifically in the following examples.

EXAMPLE 1

The electrochemical reduction of p-nitrobenzoylglutamic acid was carried out using a single electrolytic cell of filter press type.

(1) Details of the cell

| | |
|---|---|
| Cathode: | palladium black-deposited platinum-coated titanium plate (*)<br>coating thickness: 2 μm, thickness of titanium: 2 mm, effective area: 1 $dm^2$ (8cm × 12.5cm) |
| Anode: | Platinum-coated titanium plate<br>coating thickness: 2 μm, thickness of titanium: 2 mm, effective area: 1 $dm^2$ (8cm × 12.5cm) |
| Ion exchange membrane: | Nafion ®-315 (manufactured by E.I. du Pont) |

Distance between the membrane and each plate: 1.5 mm

Conditions-

| | |
|---|---|
| Catholyte: | 3 w/v % aqueous hydrochloric acid solution 250 ml |
| Anolyte: | 3 w/v % aqueous sulfuric acid solution 300 ml |
| Deposition Temperature: | 10 ± 1° C. |

Flow rate of the electrolytes in the cell: 10 cm/sec.

Method- 100 ml of 5 w/v % aqueous hydrochloric acid solution containing 0.5 g of palladium chloride $PdCl_2$ was circulated through the cathode compartment via an intertank. The deposition of palladium black on the platinum coated titanium plate was continued for 2 hours at a current density of 0.1 $A/dm^2$The procedure was repeated four times in the same manner as above. 1.2 g of palladium metal was totally deposited on the cathode plate as palladium black. After the deposition, both electrolytes are taken out of the cell and the cell was washed with pure water.

(2) Electrochemical reduction of p-nitrobenzoylglutamic acid

The electrochemical reduction was carried out using the cell specified in (1).

Initial catholyte for reduction:

| | |
|---|---|
| aqueous solution containing 2.8 g of p-nitrobenzoylglutamic acid, 2 g of sodium chloride and 6 g of hydrochloric acid | 300 ml (pH 0.7) |

-continued

| | |
|---|---|
| Solution of starting material to be fed into the cathode compartment in the course of the reduction: | |
| aqueous solution of sodium p-nitrobenzoylglutamate containing 125.3 g of p-nitrobenzoyl glutamic acid, 35 g of sodium chloride | 895 ml |
| Electrolyte to be fed into the cathode compartment in the course of the reduction: | |
| 35 w/w % aqueous hydrochloric acid solution | 150 ml |
| Anolyte: 2 w/v % aqueous sulfuric acid solution | 300 ml |
| Reduction Temperature: | 45 ± 1° C. |
| Flow rate of the electrolytes in the cell: | 15 cm/sec. |

Current was gradually lowered as shown below.

| Current (A) | 5 | 4 | 3 | 2 |
|---|---|---|---|---|
| Period for current (hours) | 12.5 | 2.5 | 1.5 | 0.5 |

Note (*):
Method and conditions for deposition

The electrochemical reduction was continued for 17 hours, while circulating both electrolytes via their intertanks by the respective circulating pumps. The solution of starting material and the electrolyte were fed in a uniform rate into the cathode compartment over a period of 12 hours from the beginning of the reduction.

After the reduction, the catholyte i.e. reaction solution was taken out of the cell and the reaction solution was quantitatvely analyzed high performance liquid chromatography [column:Uniseal ®-$C_{18}$-10 μm, 4 mmϕ×30 cm marketed by Gaschro Ind. Co., Ltd in Japan; mobile phase: aqueous solution, ammonium phosphate $NH_4H_2PO_4$ 0.02 mole %, PIC-B7 ® marketed by Waters Associates 0.7 v/v %, methanol 2.0 v/v %, acetonitrile 1.9 v/v %, pH 3.0, wavelength for measurement 254 nm].

The amount of the objective p-aminobenzoylglutamic acid produced was found to be 114.0 g. (Theoretical yield: 99.0%, Current efficiency: 88.3%).

EXAMPLE 2

The electrochemical reduction of p-nitrobenzoylglutamic acid was carried out under the same conditions as in Example 1 and using the same cell as in Example 1 except that the following conditions were adopted:

| | |
|---|---|
| Cathode: | titanium-palladium alloy plate<br>palladium content: 0.15 wt. %, thickness: 2 mm, effective area: 1 $dm^2$ (8 cm × 12.5 cm) |

Current was gradually lowered as shown below.

| Current (A) | 5 | 4 | 3 | 2 | [illegible] |
|---|---|---|---|---|---|
| Period for current (hours) | 12.5 | 3.0 | 2.0 | 1.0 | .0 |

After the reaction, the reaction mixture was subjected to the quantitative analysis according to the same analytical method as in Example 1. The amount of p-aminobenzoylglutamic acid produced was found to be 109.8 g. (Theoretical yield 95.4%; Current efficiency 79.4%).

EXAMPLE 3

The electrochemical reduction of p-hydroxyaminobenzoylglutamic acid was carried out in this Example.

p-Hydroxyaminobenzoylglutamic acid was prepared by the electrochemical reduction of p-nitrobenzoyl-glutamic acid. These reductions were executed in an electrolytic cell of filter press type, respectively.

| | | |
|---|---|---|
| (1) Preparation of sodium p-hydroxyaminobenzoylglutamate | | |
| Cathode: | titanium plate (JIS-KS-50) thickness: 2 mm, effective area: 1 $dm^2$ (8 cm × 12.5 cm) | |
| Catholyte: | aqueous solution of p-nitrobenzoylglutamic acid monosodium salt containing 42.0 g of p-nitrobenzoylglutamic acid and 12.0 g of sodium chloride | 300 ml |
| Reduction temperature: | 25 ± 1° C. | |

The current of 10A was passed through the cell for 30 minutes and, then, the current of 5A was passed though for 1.5 hours. On analysis, there was found that the reaction solution contained p-hydroxyaminobenzoylglutamic acid as a main product as given in Table 1.

(2) Electrochemical reduction of p-hydroxyaminobenzoylglutamic acid.

The reaction solution obtained in the step (1) was adjusted at pH 0.7 with 35 wt. % aqueous hydrochloric acid solution (40 ml) and this solution was circulated in the cathode compartment.

| | | | |
|---|---|---|---|
| Cathode: | palladium black-deposited platium-coated titanium plate (**) coating 2 μm, thickness of titanium: 2 mm, effective area: 1 $dm^2$ (8 cm × 12.5 cm) | | |
| Note: The deposition was carried out in the same manner as in Example 1. | | | |
| Reduction temperature: | 35 ± 1° C. | | |
| Current was gradually lowered as stated below. | | | |
| Current (A) | 10 | 5 | 1.5 |
| Period for current (hours) | 0.75 | 0.5 | 2.1 |

After the reaction, the reaction mixture was subjected to quantitative analysis and there was obtained the following result.

TABLE 1

| Electrochemical reduction Reaction product | step (1) | step (2) |
|---|---|---|
| p-hydroxyaminobenzoyl-glutamic acid | 61.5% | 0.1% |
| p-aminobenzoyl glutamic acid | 12.0 | 97.6 |
| unreacted p-nitrobenzoyl-glutamic acid | 25.5 | 0 |

Based on the starting material used

The total theoretical yield was 97.6% and the current efficiency was 86.8%.

EXAMPLE 4

In a tank type electrolytic cell which was divided into anode and cathode compartments with an ion exchange membrane C.M.V. ®, Asahi Glass Co., Ltd. [each compartment had a capacity of 150 ml and cathode compartment was equipped with a stirrer], electrochemical reduction of p-nitrobenzoylglutamic acid was carried out under the following conditions.

| | | |
|---|---|---|
| Cathode: | titanium-palladium alloy plate palladium content: 0.15 wt. %, thickness: 2 mm effective area: 0.15 $dm^2$ (3 cm × 5 cm) | |
| Anode: | platinum-coated titanium plate coating thickness: 2 μm, thickness of titanium: 2 mm effective area: 0.15 $dm^2$ (3 cm × 5 cm) | |
| Catholyte: | p-nitrobenzoylglutamic acid | 15 g |
| | sodium chloride | 5 g |
| | hydrochloric acid | 12 g |
| | aqueous solution 120 ml (pH 0.1) | |
| Anolyte: | 2 w/v % aqueous sulfuric acid solution: | 120 ml |
| Current: | 0.75 A (current density: 5 A/$dm^2$) | |
| Reduction temperature: | 35 ± 1° C. | |

The reaction was continued for 14 hours, and then the reaction mixture was quantitatively analyzed by high performance liquid chromatography. The theoretical yield of p-aminobenzoylglutamic acid was found to be 96% (current efficiency 74.5%).

EXAMPLE 5

Using a platinum-coated titanium plate (coating thickness 2.0 μm, effective area 0.15 $dm^2$), on which 0.5 g/$dm^2$ of palladium black was deposited, the electrochemical reduction was continued for 13 hours in the same manner and under the same conditions as in Example 4. After the reaction, the reaction mixture was quantitatively analyzed by high performance liquid chromatography. The theoretical yield of p-aminobenzoylglutamic acid was found to be 98.5% (current efficiency 82.3%).

CONTROL EXAMPLE 1

The electroreduction was carried out for 14 hours under the same conditions as in Example 4 except that a platinum-coated titanium plate (coating thickness: 2 μm, effective area: 0.15 $dm^2$), which was not deposited with palladium black, was used as the cathode. After the reaction, the reaction mixture was quantitatively analyzed by high performance liquid chromatography. The proportion of the unreacted starting material based on the starting material used was found to be 15% and the theoretical yield of p-aminobenzoylglutamic acid based on the starting material used was found to be 5% and that of p-hydroxyaminobenzoylglutamic acid was found to be 72%.

CONTROL EXAMPLE 2

As a starting material solution to be charged into cathode compartment, 100 ml of an aqueous solution containing 15.0 g of p-nitrobenzoylglutamic acid and 5 g of sodium chloride was prepared. To this solution was added a 30 wt. % aqueous solution of sodium hydroxide to prepare solutions at pH 11.0 and at pH 5.0. Using each of these solutions, the reduction reaction was carried out in the same manner as in Example 4. The analysis of the reaction mixture after the reduction for 14 hours was as follows:

| | Reaction product | | |
|---|---|---|---|
| | p-aminobenzoyl-glutamic acid | p-hydroxyamino compound glutamic acid | unreacted p-nitrobenzoyl- |
| pH 11.0 | trace | 16% | 12% |
| pH 5.0 | 70% | 17% | 5% |

Based on the starting material used.

EXAMPLE 6

Using an electrolytic cell of filter press type divided with an ion exchange membrane C.M.V. ®, p-nitrobenzoylglutamic acid was electrochemically reduced under the following conditions.

| | | | |
|---|---|---|---|
| Cathode: | palladium black-deposited titanium plate<br>palladium black deposited : 0.5 g.,<br>titanium material: JIS-KS-50,<br>thickness of titanium:<br>effective area: 1 $dm^2$ (8 cm × 12.5 cm) | | 2 mm |
| Anode: | platinum-coated titanium plate<br>coating thickness: 2.0 μm,<br>thickness of titanium: 2 mm<br>effective area: 1 $dm^2$ (8 cm × 12.5 cm) | | |
| Anolyte: | 2 w/v % aqueous sulfuric acid solution 250 ml | | |
| Initial catholyte: | | | |
| | p-nitrobenzoylglutamic acid | 2.5 g | |
| | hydrochloric acid | 2.6 g | |
| | sodium chloride | 13.0 g | |
| | Aqueous solution 250 ml (pH 1.0) | | |
| Starting material to be fed into cathode compartment aqueous solution of sodium p-nitrobenzoylglutamate containing 27 g of sodium chloride and 71 g of p-nitrobenzoylglutamic acid; 500 ml | | | |
| Electrolyte to be fed into cathode compartment: 35 wt. % hydrochloric acid; 45 ml | | | |
| Flow rate of electrolytes in the cell: | | | 7 cm/sec |
| Reduction temperature: | | | 35 ± 1° C. |
| Current: | | | 4 A |

The starting material and the electrolyte were continuously fed into the cathode compartment at a uniform rate over a period of 8.5 hours from the beginning of the reduction.

After a total of 12 hours, the reaction was terminated and the reaction solution was quantitatively analyzed. As a result, the theoretical yield of p-aminobenzoylglutamic acid was 98.5% (current efficiency: 81.9%).

We claim:

1. A method of producing p-aminobenzoylglutamic acid which comprises electrochemically reducing p-nitrobenzoylglutamic acid and/or p-hydroxyaminobenzoylglutamic acid using a cathode of a palladium metal or palladium alloy in an aqueous solution at a pH value of 3 or less.

2. A method according to claim 1, wherein the palladium metal is deposited on a cathode substrate in the form of palladium black.

3. A method according to claim 1, wherein the palladium alloy is a titanium-palladium alloy.

4. A method according to claim 1, wherein the electrochemical reduction is carried out in an aqueous solution at a pH value of 0.1 to 2.

5. A method according to claim 1, wherein the electrochemical reduction is carried out at a temperatures of 10° to 70° C.

6. A method according to claim 1, wherein the electrochemical reduction is carried out in an electrolytic cell which is divided into cathode and anode compartments by a diaphragm.

* * * * *